US007526876B2

(12) United States Patent
Carey et al.

(10) Patent No.: US 7,526,876 B2
(45) Date of Patent: May 5, 2009

(54) MULTIUSE DRYER AND METHOD OF DRYING MULTIPLE ITEMS

(75) Inventors: Michael J. Carey, Sand Diego, CA (US); Robert W. Murphy, San Diego, CA (US); Joseph H. Edwards, Salt Lake City, UT (US)

(73) Assignee: Seirus Innovative Accessories, Inc., Poway, CA (US)

( * ) Notice: Subject to any disclaimer, the term of this patent is extended or adjusted under 35 U.S.C. 154(b) by 161 days.

(21) Appl. No.: 11/337,431

(22) Filed: Jan. 23, 2006

(65) Prior Publication Data

US 2007/0193059 A1 Aug. 23, 2007

Related U.S. Application Data

(60) Provisional application No. 60/647,711, filed on Jan. 27, 2005.

(51) Int. Cl.
*F26B 19/00* (2006.01)

(52) U.S. Cl. ..... 34/90; 34/103; 34/104

(58) Field of Classification Search ..... 34/90, 34/103, 104, 239; 132/119, 200; 392/382, 392/384; 219/385, 390
See application file for complete search history.

(56) References Cited

U.S. PATENT DOCUMENTS

| | | | | |
|---|---|---|---|---|
| 2,443,695 | A | 6/1948 | Russell | |
| 2,614,337 | A | 10/1952 | Darbo | |
| 2,856,700 | A * | 10/1958 | Wales | 34/91 |
| 3,154,392 | A | 10/1964 | Littman | |
| 3,417,482 | A | 12/1968 | Peet | |
| 3,513,564 | A | 5/1970 | Gramprie | |
| 4,145,602 | A | 3/1979 | Lee | |
| 4,198,765 | A | 4/1980 | Miyamae | |
| 4,768,293 | A | 9/1988 | Kaffka | |
| 4,787,153 | A | 11/1988 | Chen | |
| 5,287,636 | A | 2/1994 | Lafleur et al. | |
| 5,289,642 | A | 3/1994 | Sloan | |
| 5,592,750 | A * | 1/1997 | Eichten | 34/104 |
| 5,632,099 | A | 5/1997 | Seifert et al. | |
| 5,720,108 | A | 2/1998 | Rice | |
| 5,894,680 | A | 4/1999 | Dalvy et al. | |
| 6,796,053 | B2 * | 9/2004 | Lurie | 34/104 |
| 2003/0182817 | A1 | 10/2003 | Macher et al. | |
| 2005/0097768 | A1 * | 5/2005 | Burns et al. | 34/90 |

* cited by examiner

*Primary Examiner*—S. Gravini
(74) *Attorney, Agent, or Firm*—Holme Roberts & Owen, LLP

(57) ABSTRACT

A drying apparatus includes a housing, a tubular arm, a telescoping arm and a fan. The tubular arm is attached to the housing at a portion between proximal and distal ends. Also, the tubular arm is able to rotate tangential to the housing. The tubular arm includes a proximal end and a distal end and is attached to the housing at a portion between the proximal and distal ends. The telescoping arm is attached to the tubular arm and able to slide between an open and closed position. The telescoping arm includes an aperture that is open in the open position and covered in the closed position. The fan encased within the housing and arranged to direct airflow through the tubular arm and out the aperture when the telescoping arm is in the open position. The air flow is restricted when the telescoping arm is in the closed position.

16 Claims, 8 Drawing Sheets

MULTIUSE DRYER AND METHOD OF DRYING MULTIPLE ITEMS

BACKGROUND OF THE INVENTION

1. The Field of the Invention

The present invention generally relates to a dryer, more specifically the invention relates to dryer capable of drying multiple items.

2. The Relevant Technology

Dryer mechanisms have been developed to dry footwear. For example, in U.S. Pat. No. 4,768,293, an apparatus for blowing air into footwear for warming and drying the footwear is provided. The dryer mechanism has a seal for sealing an open or ankle portion of the footwear, a duct assembly having intake and exhaust ports, and a discharge tube. The seal encircles the discharge tube and has a range of effective diameters to accommodate open portions of footwear of different sizes. The discharge tube is telescopically extensible and retractable of the seal to accommodate footwear of different heights and to retract within the seal for storage. A fan, communicating with the duct assembly and a heating element, draws air into the intake duct and discharges it through the discharge tube into the shoe. The dryer mechanism can be used to warm and dry footwear ranging from high stiff ski boots to low soft running shoes, and accommodates a wide range of sizes of such footwear. The dryer mechanism, however, only accommodates footwear.

Other dryers have been adapted to accommodate footwear and gloves. In U.S. Pat. No. 4,145,602 a ski boot and glove warmer is disclosed. The warmer includes a vertically extending blower body having a pair of spaced apart dryer tubes projecting horizontally from the front face thereof. Each tube has a boot support bail spaced below the tube for supporting the back of a boot. The tubes project into the ankle portion of the boot to direct hot air into the foot area. A pair of guides are positioned on opposite sides of the tubes for retaining the boots when the toes are arranged upwardly from the support. An electric blower directs air over a heating element and into the tubes. The warmer, however, cannot accommodate gloves and boots at the same time. Also, the guides and tubes are fixed and cannot be adjusted to fit different sizes of gloves and boots.

BRIEF SUMMARY OF THE INVENTION

In various exemplary embodiments of the present invention, a drying apparatus is provided. The drying apparatus includes a housing, a tubular arm, a telescoping arm and a fan. The tubular arm is attached to the housing at a portion between proximal and distal ends. Also, the tubular arm is able to rotate tangential to the housing. The tubular arm includes a proximal end and a distal end and is attached to the housing at a portion between the proximal and distal ends. The telescoping arm is attached to the tubular arm and able to slide between an open and closed position. The telescoping arm includes an aperture that is open in the open position and covered in the closed position. The fan encased within the housing and arranged to direct airflow through the tubular arm and out the aperture when the telescoping arm is in the open position. The air flow is restricted when the telescoping arm is in the closed position.

A method of drying items of apparel is also provided. The method includes providing a drying apparatus including a housing and an arm adapted to receive a boot and a glove. Next, the arm is rotated in a plane parallel to the surface of the housing. Then, the method involves positioning one end of the arm within the boot and another end of the arm within a glove. Next, the boot and glove are dried using the drying apparatus.

These and other features of the present invention will become more fully apparent from the following description and appended claims, or may be learned by the practice of the invention as set forth hereinafter.

BRIEF DESCRIPTION OF THE DRAWING

To further clarify the above and other advantages and features of the present invention, a more particular description of the invention will be rendered by reference to specific embodiments thereof which are illustrated in the appended drawings. It is appreciated that the drawings depict only typical embodiments of the invention and are therefore not to be considered limiting of its scope. The invention will be described and explained with additional specificity and detail through the use of the accompanying drawings in which.

DETAILED DESCRIPTION OF THE PREFERRED EMBODIMENTS

Reference will now be made in detail to the preferred embodiments of the present invention, examples of which are illustrated in the accompanying drawings. The various exemplary embodiments provide examples of a dryer apparatus capable of drying multiple items.

The present invention has an adjustable design, which accommodates multiple combinations of gloves and footwear. For example, the drying apparatus can be adapted to dry one glove and one boot, two boots, two gloves or two gloves and two boots, and so on. Although the drying apparatus is illustrated as drying gloves and foot wear, it can also be used to dry other apparel, such as hats, socks and the like. Commonly, gloves and boots, when used in snow as in skiing, become wet. When a skiers gloves and boots become wet, they are less effective for keeping out the cold weather.

The drying apparatus 10 can be used while traveling. A person's gloves and boots will get wet when using them in the snow. When the person has an opportunity to dry the wet gloves and boots, the drying apparatus 10 can be used in a standard electrical outlet. The drying apparatus has a compact design so that it can be easily carried with the person. When the drying apparatus is not in use, the arms can be telescoped and rotated to reduce its size.

Figure 1:
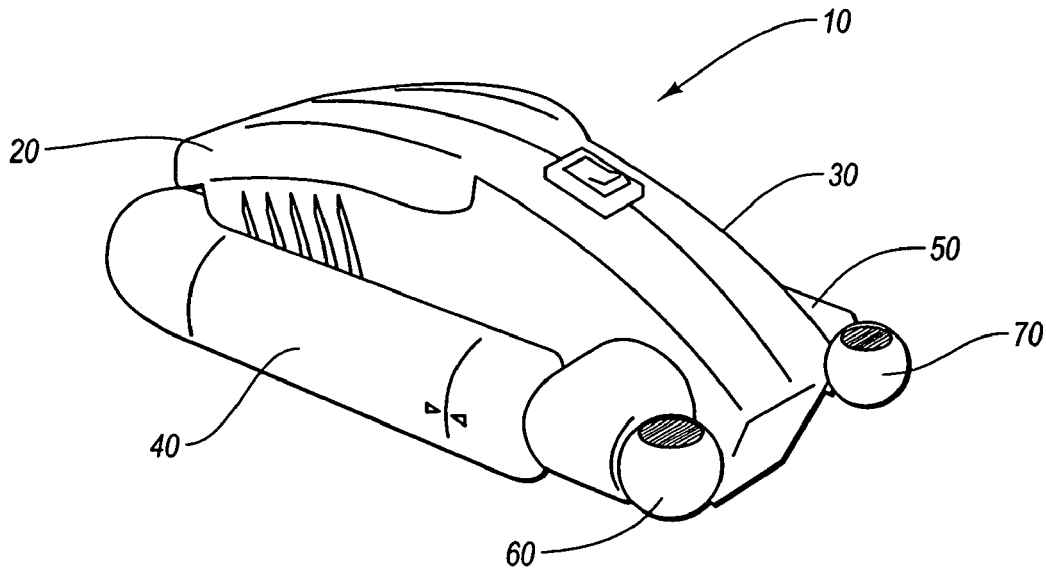
FIG. 1 is a perspective view of an embodiment a drying apparatus in accordance with the present invention.

One embodiment of a drying apparatus 10 is illustrated in FIG. 1 in accordance with the present invention. FIG. 1 illustrates the drying apparatus 10 including a first housing portion 20, a second housing portion 30, a first tubular drying arm 40, a second tubular drying arm 50, a first extension, or telescoping arm, 60 and a second extension, or telescoping arm, 70. The drying apparatus 10 illustrated in FIG. 1 is shown in a compact position for storage and carrying the apparatus.

Figure 2:
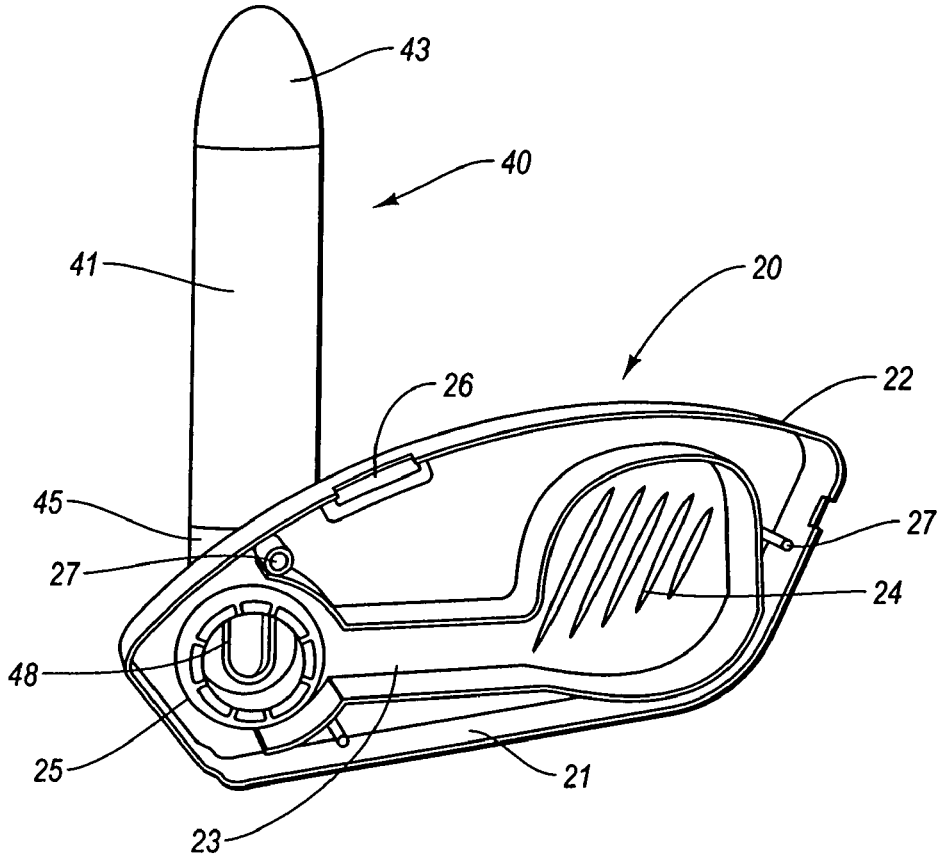
FIG. 2 is a detailed inner view of a section of a drying apparatus in accordance with the present invention.
Figure 3:
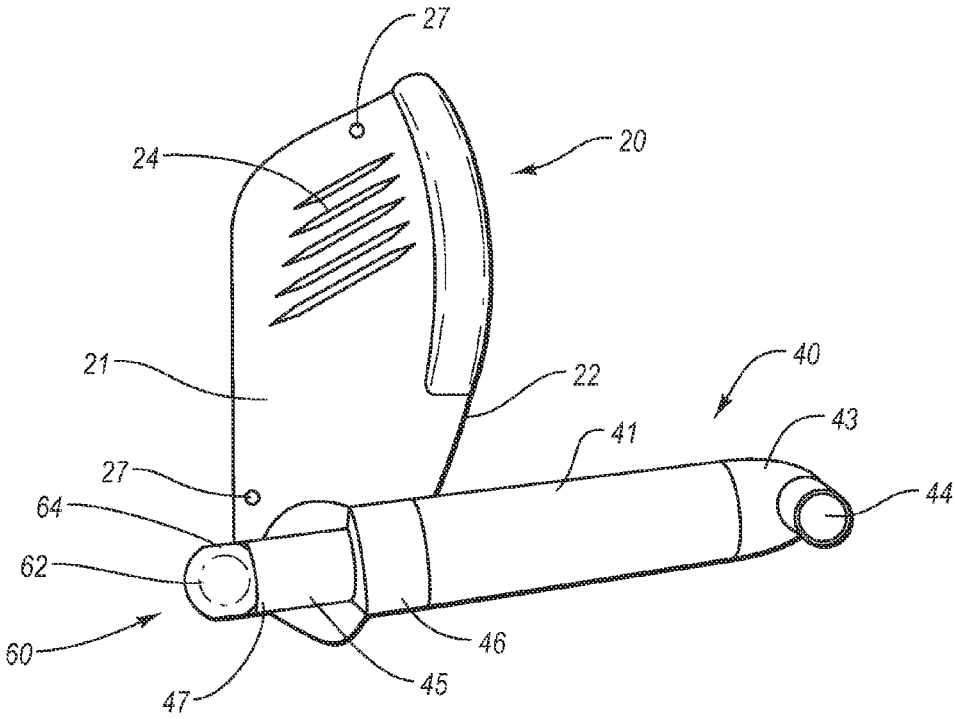
FIG. 3 is a detailed outer view of the section of the drying apparatus of FIG. 2.
Figure 4:
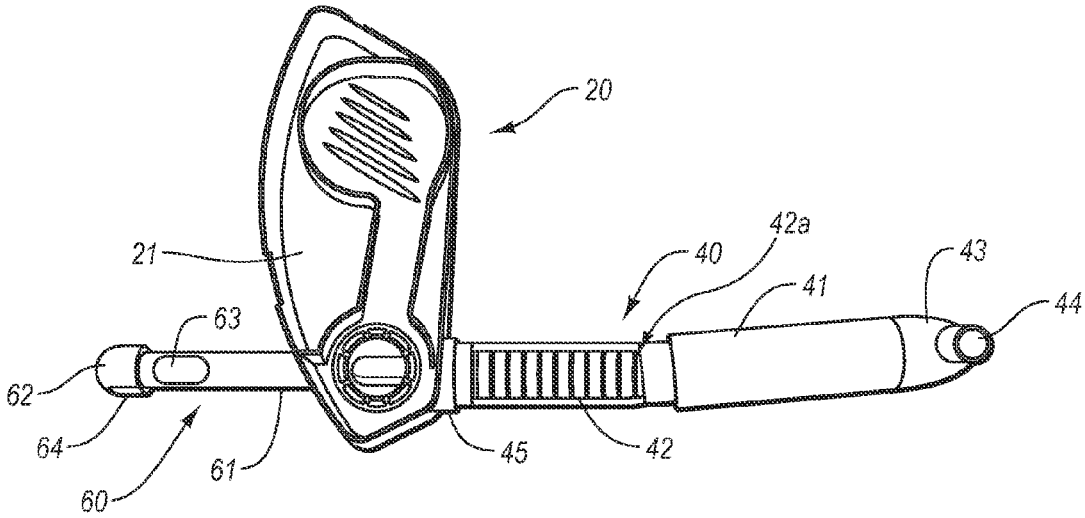
FIG. 4 is a detailed inner view of the section illustrated in FIG. 2 in an extended position.

The first housing portion 20 is further illustrated in FIGS. 2-4. The second housing portion 30 is similar to the first housing portion 20. As such, the first and second housing portions 20, 30 are designed to fit together. The first and second housing portions 20, 30 are preferably made of a lightweight material, such as plastic. The first and second housing portions are made, for example, by molding each piece separately, then assembling the first and second housing portions 20, 30 and other components together. The first housing portion 20 includes a surface 21, a side wall 22, a channel 23, a vent 24, a connection aperture 25, a switch recess 26 and fasteners 27.

The side wall 22 extends around the perimeter of the surface 21. The vent 24 and connection aperture 25 are formed or cut into the surface 21. The channel 23 is formed on the surface 21 and extends between and around the vent 24 and the connection aperture 25. The channel 23 directs the air flow from the vent 24 to the connection aperture 25 or from the connection aperture 25 to the vent 24. The switch recess 26 is positioned on the side wall 22 to accommodate a switch 84, discussed below. The first and second housing portions 20, 30 are assembled together using fasteners 27, such as screws, bolts and nuts, adhesive and the like.

The first tubular drying arm 40 includes a first outer tube section 41, a first inner tube section 42, a first air-flow director 43, an aperture 44 and a connector 45. The first outer and first inner tube sections 41, 42 are made from a hollow tube, such as pipe. The first outer and first inner tube sections 41, 42 may be made from, for example, plastic, metal or composite materials. To assist in fitting the first tubular drying arm 40 into an article of apparel, such as a glove 100 or a boot 110, the first inner tube section 42 can be flexible. In the preferred embodiment of the invention, the first inner tube section 42 may include a flexible portion connected to the connector 45 and a rigid portion fixed to an outer end 42*a*, or the first inner tube telescoping end, of inner tube section 42. The first inner tube section 42 is designed to fit inside the first outer tube section 41. The outer and inner tube sections 41, 42 may be made from any shape, for example, square, round, oval and the like.

The first outer and first tube sections 41, 42 are connected to the first housing portion 20 using the connector 45. The connector 45 includes a tubular arm connector portion 46 and a telescoping arm, or first extension, connector portion 47. The first inner tube section 42 is attached to the tubular arm connector portion 46 and the first outer tube section 41 is fit over the tubular arm connector portion 46. The first outer tube section 41 is able to slide between a collapsed position where it is attached to the connector 45 and an extended position where first outer tube section 41 is slid out to an outer end 42*a*, or the first inner tube telescoping end, of the inner tube section 42. The first inner tube section 42 includes a device such as a flange (not shown) on the outer end 42*a*, or the first inner tube telescoping end, to prevent the first outer tube section 41 from sliding completely off the first inner tube section. The collapsed position is illustrated in FIG. 3 and the extended position is illustrated in FIG. 4.

The connector 45 includes tabs 48. The tabs 48 slide into the connection aperture 25 of the first housing portion 20 and lock into place. The tabs 48 allow the connector 45 to lock into place, yet allow the connector 45 to rotate within the connection aperture 25.

The first airflow director 43 is attached to the first outer tube section 41. In the present embodiment, the air flow director 43 has an elbow shape. The first airflow director 43 can be rotated by rotating the first outer tube section 41 or locked in place by locking the first outer tube section 41 to the connector 45. The first air-flow director 43 directs air through the aperture 44 and into a glove 100 or boot 110. The aperture 44 is oval-shaped having a length of about 0.75 inches and a width of about 0.5 inches. The aperture may be shaped any size to sufficiently dry an item of apparel, and may be round-shaped, square-shaped or the like.

As shown in FIG. 4, the first extension, or telescoping arm, 60 includes a tube section 61, an end cap 62 and an aperture 63. The tube section 61 is attached to the connector 45 at the first extension, or telescoping arm, connector portion 47. The first extension, or telescoping arm, 60 extends or telescopes between a closed position, as shown in FIG. 3, and an open position, as shown in FIG. 4. In the closed position, the aperture 63 is contained within the connector 45. The aperture 63 is sized to allow a sufficient amount of air to be released to dry an additional item when the first extension, or telescoping arm, 61 is in the open position. In the preferred embodiment, the aperture 63 is an oval shape having a length of about 0.875 inches and a width of about 0.5 inches. The aperture may also be round-shaped, square-shaped or the like. The end cap 62 is attached to the end of the tube section 61, so that when the tube section 61 is in the closed position, the end cap 62 prevents air from flowing out of the first telescoping arm 60. The end cap 62 may also include a gripping surface 64 to assist in extending the first extension, or telescoping arm, 60 to the open position.

The second housing portion 30 and second tubular drying arm 50 are connected in a similar manner as the first connection housing 20 and the first tubular drying arm 40. The second housing portion 30 includes a surface 31, a side wall 32, a vent 34 and a connection aperture 35. The side wall 32 extends around the perimeter of the surface 31. The vent 34 and connection aperture 35 are formed or cut into the surface 31.

Figure 5:
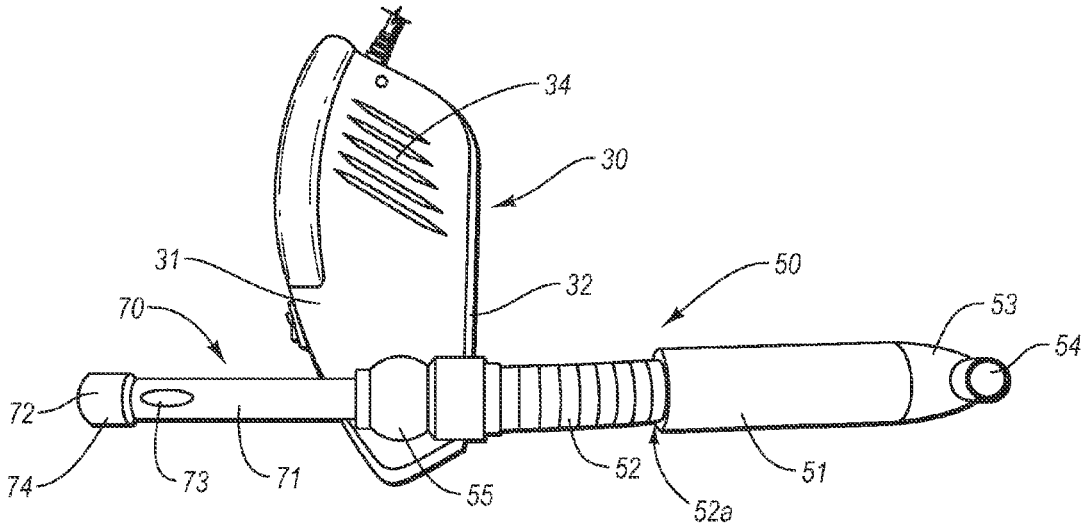
FIG. 5 is a detailed outer view of another section of the drying apparatus in an extended position.

As shown in FIG. 5, the second tubular drying arm 50 includes a second outer tube section 51, second inner tube section 52, second air flow director 53, an aperture 54 and a connector 55. The second outer and second inner tube sections 51, 52 can be made of materials referred to above with respect to the first outer and first inner tube sections 41, 42 of the first tubular drying arm 40. The second outer and second inner tube sections 51, 52 are connected to the second housing portion 30 using the connector 55 in a similar manner as discussed above with respect to the first outer and first inner tube sections 41, 42 and the connector 45. The second outer tube section 51 is able to slide between a collapsed position where it is attached to the connector 55 and an extended position where second outer tube section 51 is slid out to an outer end 52*a*, or the second inner tube telescoping end, of the second inner tube section 52. The motion and restriction is similar to the first outer and first inner tube sections 41, 42 described above.

The second airflow director 53 is attached to the second outer tube section 51. The shape and function of the second airflow director 53 is similar to that of the air flow director 43 discussed above. The second air-flow director 53 directs air through the aperture 54 and into the glove 100 or boot 110. The aperture 54 is shaped similar to that of aperture 44.

The second extension, or telescoping arm, 70 is also connected in a similar manner as the first extension, or telescoping arm, 60. The second extension, or telescoping arm, 70 includes a tube section 71, an end cap 72 and an aperture 73. The second extension, or telescoping arm, 70 extends or telescopes between a closed position and an open position as discussed above with respect to the first extension, or telescoping arm, 60. In the closed position, the aperture 73 is contained within the connector 55. The aperture 73 is sized to allow a sufficient amount of air to be released to dry an additional item when the second extension, or telescoping arm, 70 is in the open position similar to that of aperture 63. The end cap 72 is attached to the end of the tube section 71, so that when the tube section 71 is in the closed position, the end cap 72 prevents air from flowing out of the second extension, or telescoping arm, 70. The end cap 72 may also include a gripping surface 74 to assist in extending the second extension, or telescoping arm, 70 to the open position.

Figure 6:
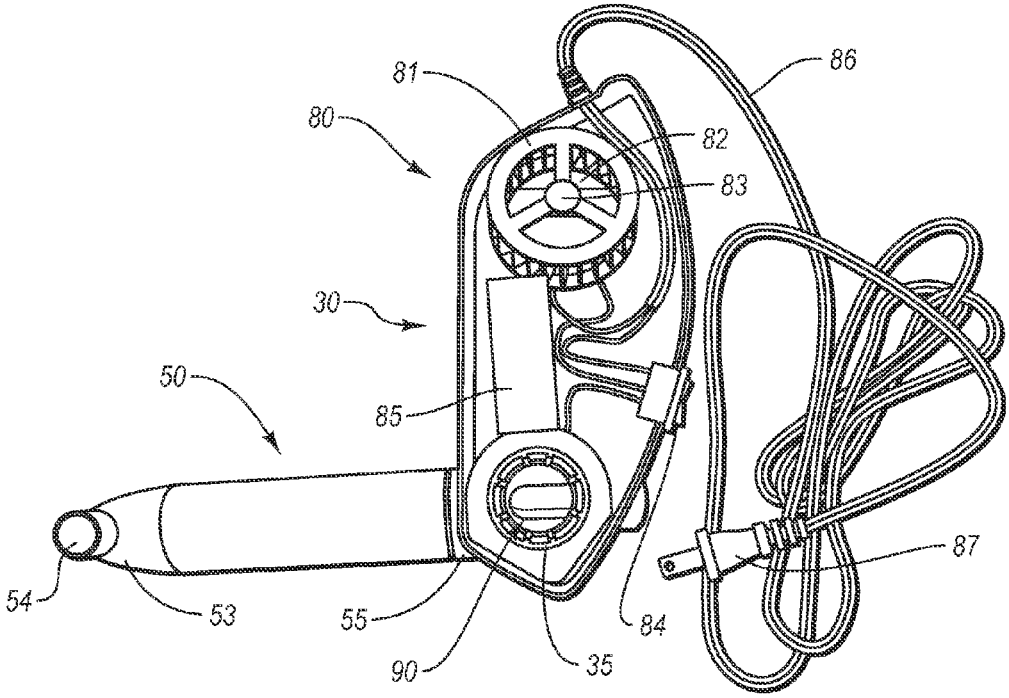
FIG. 6 is a detailed inner view of the section of FIG. 5.

FIG. 6 illustrates the inner components of the drying apparatus 10. The drying apparatus 10 includes a drying assembly 80. The drying assembly 80 includes a fan wheel 81, a motor 82, a pivot 83 and a switch 84. The drying assembly 80 is attached to the second housing portion 30. The fan wheel 81 is attached to the motor 82 using the pivot 83. The fan wheel 81 can be made from a cylindrical structure as in a case of a squirrel cage fan.

When the fan wheel 81 rotates, it pushes air through the channel 23, through the first and second tubular drying arms 40, 50 and out the first and second air-flow directors 43, 53. When the first and second extension, or telescoping arms, 60, 70 are in the open position, the fan wheel also directs air through the first and second extension, or telescoping arms, 60, 70.

The drying assembly 80 can also include a heater 85. The heater 85 is positioned in the path of the air flow from the fan wheel 81. The heater 85 adds heat to the air being directed through the first and second tubular drying arms 40, 50 and the first and second extensions, or telescoping arms, 60, 70 when the first and second extension, or telescoping arms, 60, 70 are in the open position. The switch 84 electrically connects the motor 82 and, if used, the heater 85. The switch 84 can be switched between an off position, cold air position and hot air position. The switch 84 is attached to the first and second housing portions 20, 30 and connected to an electrical cord 86. The electrical cord 86 includes a plug 87 on the opposing end of the switch 84. The plug 87 can be sized to be inserted into an electrical outlet. In addition, the plug may be sized to be inserted into an accessory outlet of an automobile when the motor 82 and heater 85 are reconfigured to meet the same voltage output.

Figure 7:
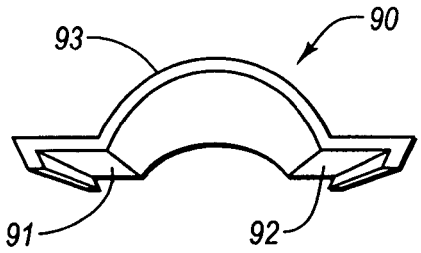
FIG. 7 is a top view of a deflection plate illustrated in FIG. 6.
Figure 8:
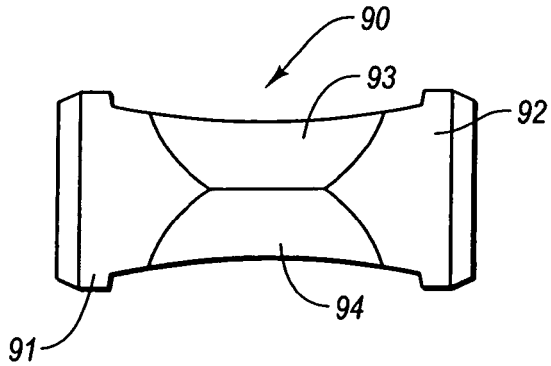
FIG. 8 is a side view of the deflection plate of FIG. 7.

FIGS. 7 and 8 illustrate a deflection plate 90 positioned in the channel 23 over the connection aperture 25, as shown in FIG. 6. The deflection plate 90 directs air flow from the drying apparatus 80 to the first and second tubular drying arms 40, 50 and the first and second extensions, or telescoping arms, 60, 70. The deflector plate 90 includes a first end 91, a second end 92, a first recess 93 and a second recess 94.

The deflection plate 90 is sandwiched between the first and second housing portions 20, 30 perpendicular to the air flow. The first and second ends 91, 92 are attached to the channel 23 directly over the connectors 45, 55 using a slot, fasteners, adhesive, or the like. To further assist in directing the air flow, the deflection plate 90 includes the first recess 93 shaped in a conical shape above a midsection of the deflection plate 90 and the second recess 94 also shaped in a conical shape below the midsection of the deflection plate 90.

Figure 9:
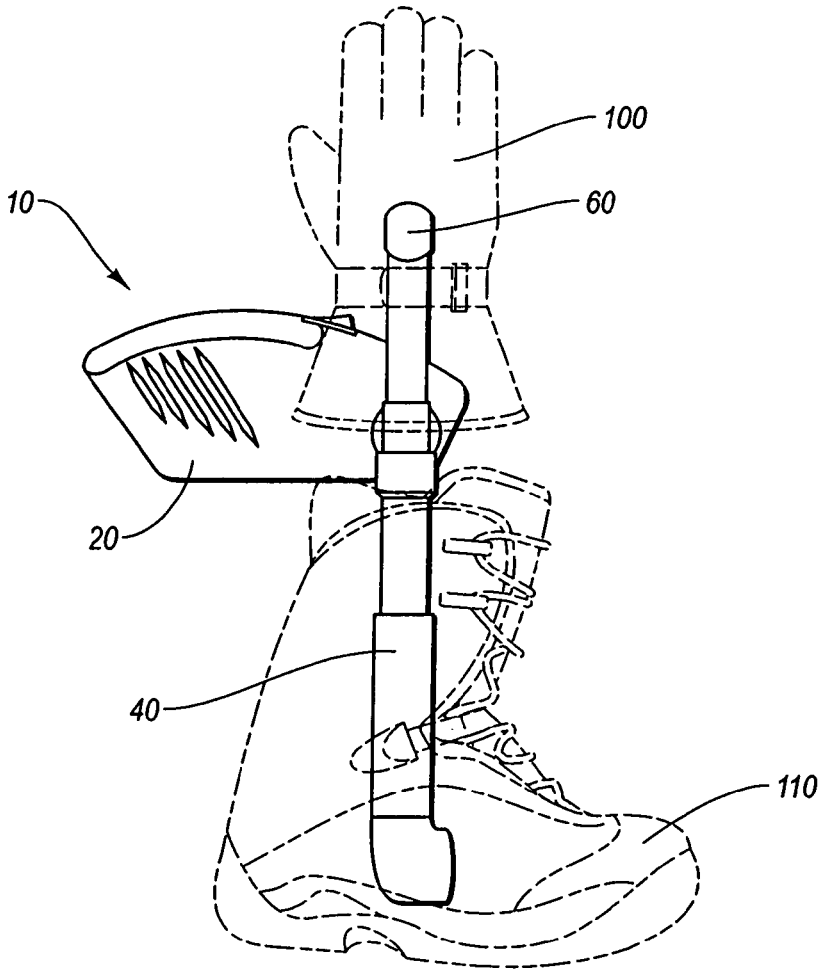
FIG. 9 is a schematic side view of a drying apparatus illustrating drying of a glove and boot.
Figure 10:
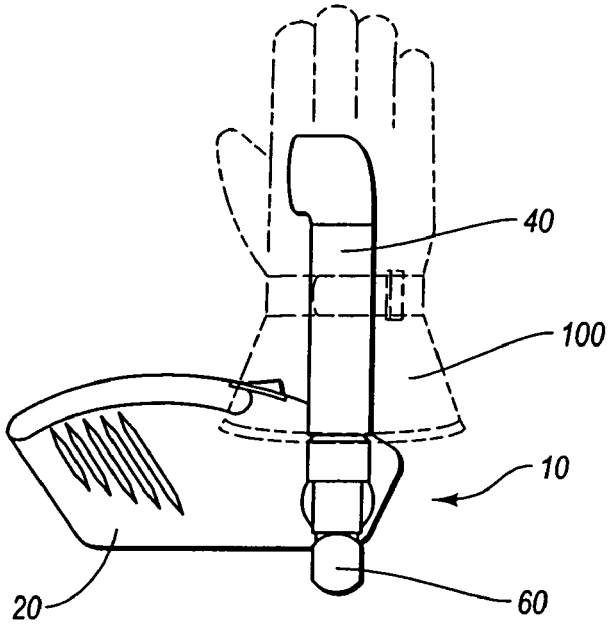
FIG. 10 is a schematic side view of a drying apparatus illustrating drying of a glove.
Figure 11:
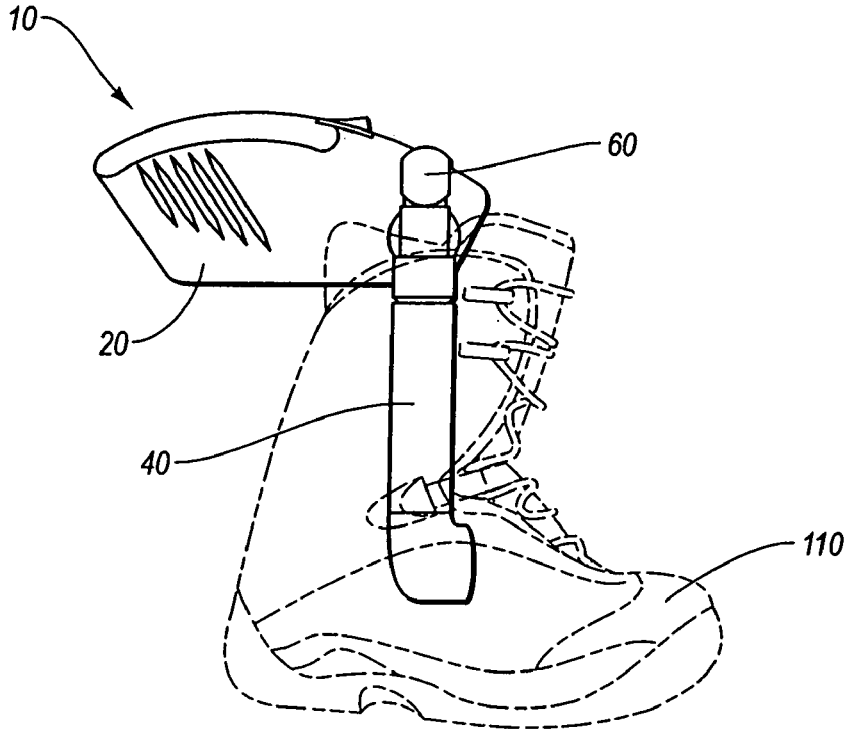
FIG. 11 is a schematic side view of a drying apparatus illustrating drying of a boot.

FIGS. 9-11 illustrate the drying apparatus 10 being used to dry gloves 100 and boots 110. In FIG. 9, the drying apparatus 10 is shown drying a combination of gloves 100 and boots 110. The first extension, or telescoping arm, 60 is in the open position and a glove 100 is placed over the first extension, or telescoping, arm 60. The first tubular drying arm 40 is extended and placed into the boot 110. In this scenario, gloves 100 and boots 110 can be dried at the same time. Although the glove 100 is shown to be place on the first extension, or telescoping arm, 60 and the boot 110 is shown to be inserted on the first tubular drying arm 40, the drying apparatus can be reversed so that the glove 100 is placed on the first tubular drying arm 40 and the boot 110 is placed on the first extension, or telescoping arm, 60.

In FIG. 10, the first tubular drying arm 40 is rotated to extend above the first and second housing 20, 30. The glove 100 is placed on the first tubular drying arm 40. The first tubular drying arm 40 is in the collapsed position. The first extension, or telescoping arm, 60 is in the closed position so that the air is directed out the first tubular drying arm 40 into the glove 100. In this scenario, the drying apparatus is used to only dry the glove 100.

FIG. 11 illustrates the first tubular drying arm 40 rotated to extend below the first and second housing 20, 30. The drying apparatus 10 is placed in the boot 110 so that the first tubular drying arm 40 extends into the boot 110. The first tubular drying arm 40 may or may not be in the extended position depending on where the user desires to direct the air flow into the boot 110. The first extension, or telescoping arm, 60 is in the closed position so that the air is directed out the first tubular drying arm 40 into the boot 110. In this scenario, the drying apparatus is used to only dry the boot 110.

Figure 12:
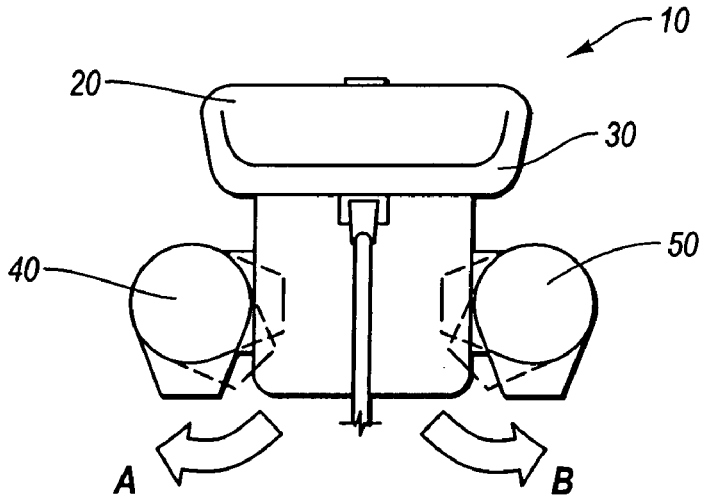
FIG. 12 is a schematic front view of a drying apparatus illustrating rotation in directions A and B.
Figure 13:
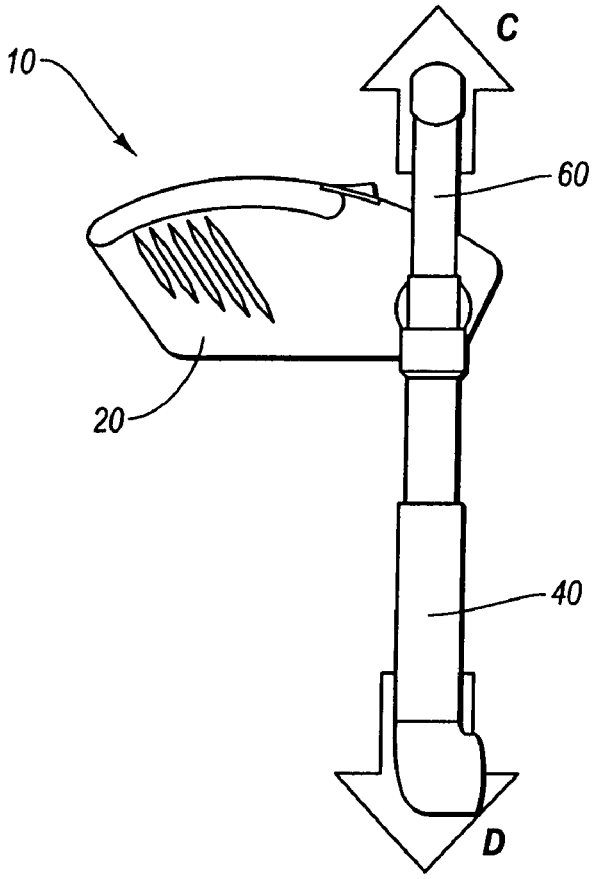
FIG. 13 is a schematic side view of a drying apparatus illustrating sliding in directions C and D.
Figure 14:
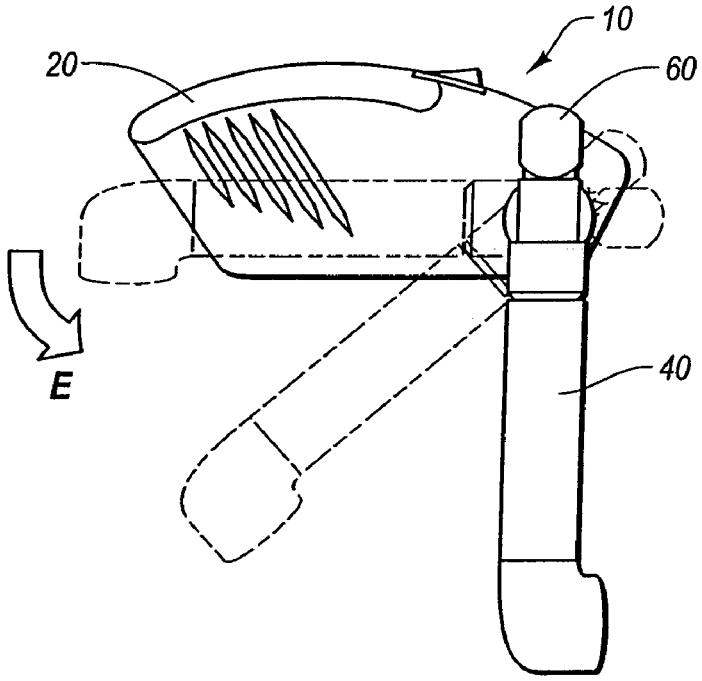
FIG. 14 is a schematic side view of a drying apparatus illustrating rotation in direction E.

FIGS. 12-14 illustrate the movement of the first and second tubular drying arms 40, 50 and the first and second extension, or telescoping arms, 60, 70. In FIG. 12, the airflow direction is varied by rotating the first and second tubular drying arms 40, 50 in direction A and B, respectively. The rotation of the first and second tubular drying arms 40, 50 in direction A and B, respectively, rotates the first and second airflow directors 43, 53 as discussed above. The first and second tubular drying arms 40, 50 are free to rotate in direction A and B while in the extended position and can be locked in position, restricting rotation, when in the collapsed position.

In FIG. 13, the drying apparatus 10 is illustrated with various sliding directions C and D. The first extension, or telescoping arm, 60 is illustrated with a sliding direction C, which allows the first extension, or telescoping arm, 60 to be adjusted from a closed position to an open position. The first extension, or telescoping arm, 60 may be fixed from rotating in a plane perpendicular to the direction C by forming the first telescoping arm 60 with flat sides. The first tubular drying arm 40 is illustrated with a sliding direction D. The sliding direction D allows the first tubular drying arm 40 to be adjusted between a collapsed position and an extended position. The second extension, or telescoping arm, 70 and the second tubular drying arm 50 may also be adjusted in directions C and D, respectively, as discussed above with respect to first extension, or telescoping arm, 60 and first tubular drying arm 40.

Figure 15:
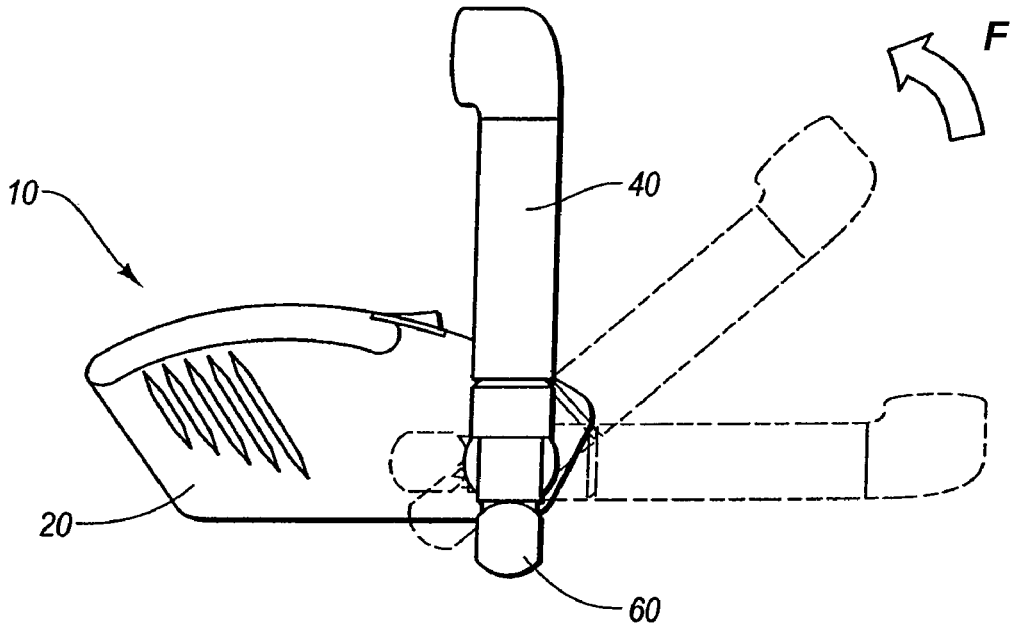
FIG. 15 is a schematic side view of a drying apparatus illustrating rotation in direction F.

FIGS. 14 and 15 illustrate the first tubular drying arm 40 and the first extension, or telescoping arm, 60 rotating in directions E and F. In FIG. 14, the first tubular drying arm 40 and the first extension, or telescoping arm, 60 rotate in direction E from a stored position to a use position below the drying apparatus 10. FIG. 15 illustrates the first tubular drying arm 40 and the first extension, or telescoping arm, 60 rotating in a direction F. The position of the first tubular drying arm 40 and the first extension, or telescoping arm, 60 is adjusted by rotating the connector 45 about the first housing portion 20. The connector 45 may include indents to rotate the first tubular drying arm 40 and the first extension, or telescoping arm, 60 between preset positions. For example, the preset positions may be set for 45 degree angles, as illustrated in FIGS. 14 and 15.

Figure 16:
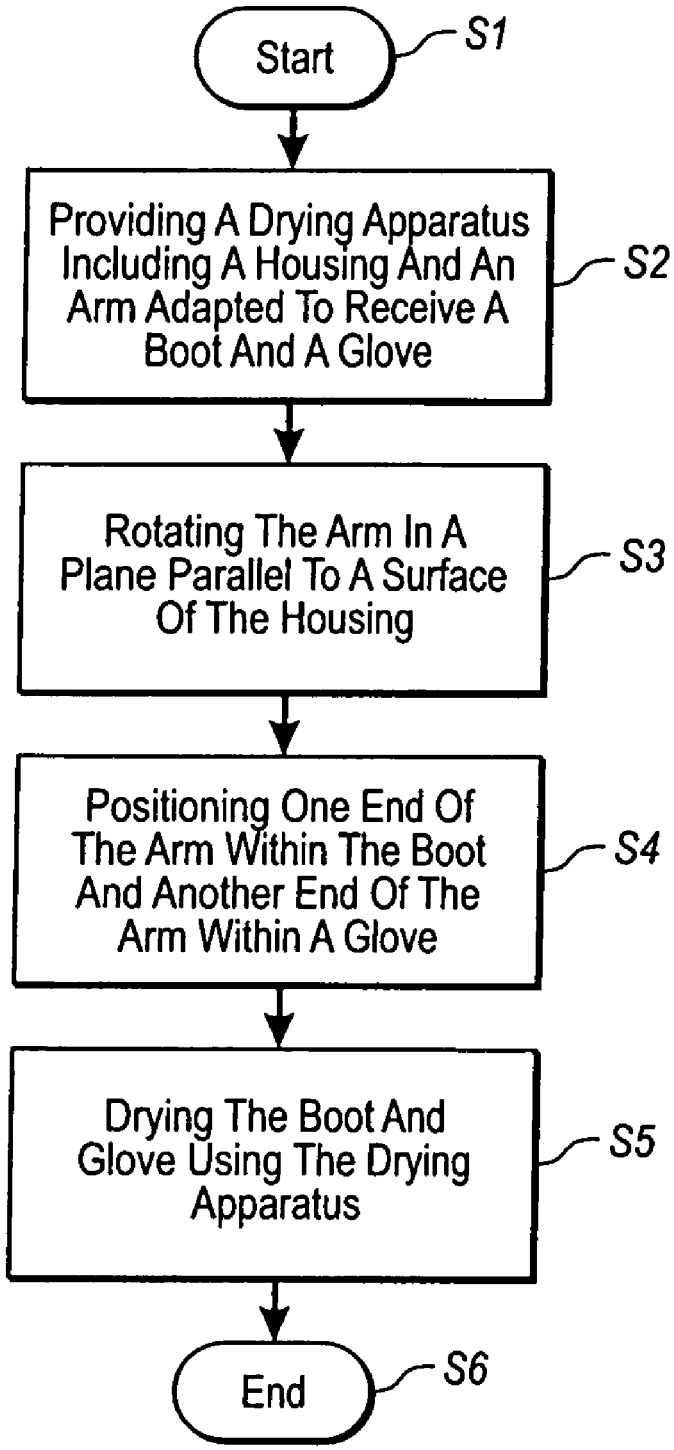
FIG. 16 is a flow chart illustrating an embodiment of a method of drying in accordance with the present invention.

FIG. 16 is a flow chart representing a method of drying items of apparel in accordance with the present invention. The method starts in step S1 and continues to step S2 where a drying apparatus including a housing and an arm adapted to receive a boot and a glove is provided. Next, step S3 involves rotating the arm in a plane parallel to the surface of the housing. In step S4, the method involves positioning one end of the arm within the boot and another end of the arm within a glove. Next, step S5 involves drying the boot and glove using the drying apparatus. Finally, the process progresses to step S6 where the method ends.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A drying apparatus comprising:

a housing having a first surface with a first housing aperture formed therein;

fan means positioned within said housing for urging air through said first housing aperture;

a first drying arm having a first end and a second end spaced from said first end, said first drying arm having a first channel for communicating air therethrough and said second end of said first drying arm having an aperture for communicating air therethrough with said first channel;

a first housing connector connected to said first drying arm between said first end and said second end and connected to said first housing aperture, said first housing connector being formed for communicating air between said first housing aperture and said first channel of said first drying arm and said first housing connector being rotatably connected to said first housing aperture;

a first extension having a first extension top end, a first extension bottom end and a first extension channel extending therein between, said first extension bottom end being associated with said first end of said first drying arm to place said first extension channel in communication with said first channel for communicating air therebetween, said first extension and said first drying arm being pivotaily rotatable with said first housing connector, said first extension being movable in a radial direction along a common axis extending through said first extension and said first drying arm, said first extension being movable relative to said first drying arm between a closed position in which said first extension top end is proximate said first end of said first drying arm and an open position in which said first extension top end is positioned a distance away from said first end, said first extension top end being configured to communicate air therethrough.

2. The drying apparatus of claim 1, further including a first airflow director attached to said second end of said first drying arm and formed to communicate air between said first channel and an aperture of said first airflow director.

3. The drying apparatus of claim 2, wherein said aperture of said first airflow director has an axis and wherein said first airflow director is movable to position said axis between a first orientation and a second orientation different from said first orientation.

4. The drying apparatus of claim 3 wherein said fan means urges air toward said first housing aperture, through said first channel and out of said first airflow director.

5. The drying apparatus of claim 1, wherein said first drying arm includes a first outer tube section having said first outer tube end and a first outer tube telescoping end and a first inner tube section having a first inner tube end and first inner tube telescoping end, said first outer tube telescoping end and said first inner tube telescoping end configured to telescope relative to each other between a first telescope position and a second telescope position spaced from said first telescope position, wherein said first housing connector is connected to said first inner tube end and wherein said first outer tube end of said first outer tube section is said second end of said first drying arm.

6. The drying apparatus of claim 5 wherein said first outer tube section is formed from a substantially rigid material, and wherein said first inner tube section includes at least a portion of hollow flexible tubing.

7. The drying apparatus of claim 1, wherein said housing has a second surface with a second housing aperture formed therein, wherein said drying apparatus further includes a second drying arm having a first end and a second end spaced from said first end, said second drying arm having a second channel for communicating air therethrough and said second end of said second drying arm having an aperture for communicating air therethrough with said second channel, a second housing connector connected to said second drying arm between said first end and said second end of said second drying arm and connected to said second housing aperture, said second housing connector being formed for communicating air between said second housing aperture and said second channel of said second drying arm and said second housing connector being rotatably connected to said second housing aperture, a second extension having a second extension top end, a second extension bottom end and a second extension channel extending therein between, said second extension bottom end being associated with said first end of said second drying arm to place said second extension channel in communication with said second channel for communicating air therebetween, said second extension and said second drying arm being pivotally rotatable with said second housing connector, second extension being movable in a radial direction along a common axis extending through said second extension and said second drying arm, said second extension being movable relative to said second drying arm between a closed position in which said second extension top end is proximate said first end of said second drying arm and an open position in which said second extension top end is positioned a distance away from said first end, said second extension top end being configured to communicate air therethrough.

8. The drying apparatus of claim 7, wherein said second drying arm includes a second outer tube section having said second outer tube end and a second outer tube telescoping end and a second inner tube section having a second inner tube end and second inner tube telescoping end, said second outer tube telescoping end and said second inner tube telescoping end configured to telescope relative to each other between a third telescope position and a fourth telescope position spaced from said third telescope position, wherein said second housing connector is connected to said second inner tube end and wherein said second outer tube end of said second outer tube section is said second end of said second drying arm.

9. The drying apparatus of claim 8 wherein said first drying arm and said second drying arm are sized to position said first outer tube end and said second outer tube end inside of a ski boot to direct air toward the toe of said ski boot and wherein said first extension and said second extension are sized in length in their respective open positions to receive and support a glove.

10. A drying apparatus comprising:

housing portion with a first housing aperture and a second housing aperture formed therein;

a fan positioned within said housing and operable to urge air out of said first housing aperture and said second housing aperture;

a first drying arm having a first outer tube section having a first outer tube end and a first outer tube telescoping end, a first inner tube section having a first inner tube end and a first inner tube telescoping end, said first outer tube telescoping end and said first inner tube telescoping end being configured to telescope relative to each other between a first telescope position and a second telescope position spaced from said first telescope position, said first outer tube section and said first inner tube section having a first channel formed therein for communicating air therethrough, said first drying arm being sized in length to extend from the top of a ski boot to proximate the sole of said ski boot;

a first housing connector rotatably connected to said first housing aperture and to said first drying arm, said first drying arm having a first passageway for communicating said air from said first housing aperture into said first channel;

a second drying arm having a second outer tube section having a second outer tube end and a second outer tube telescoping end, a second inner tube section having a second inner tube end and a second inner tube telescoping end, said second outer tube telescoping end and said second inner tube telescoping end being configured to telescope relative to each other between a third telescope position and a fourth telescope position spaced from said third telescope position, said second outer tube section and said second inner tube section having a second channel formed therein for communicating air therethrough, said second drying arm being sized in length to extend from the top of a ski boot to proximate the sole of said ski boot;

a second housing connector rotatably connected to said second housing aperture and to said second drying arm, said second drying arm having a second passageway for communicating said air from said second housing aperture into said second channel;

a first extension having a first extension top end, a first extension bottom end and a first extension channel extending therein between, said first extension bottom end being associated with said first inner tube end of said first inner tube section to place said first extension channel in communication with said first channel for communicating air to said first extension top end, said first extension and said first drying arm being pivotally rotatable with said first housing connector, said first extension movable in a radial direction along a common axis extending through said first extension and said first inner tube section, said first extension being movable relative to said first inner tube section between a closed position in which said first extension top end is proximate said first inner tube end of said first inner tube section and an open position in which said first extension top end is positioned a distance away from said first inner tube end selected to receive and support a glove thereon, said first extension top end being configured to communicate air therethrough into said glove positioned thereon;

a second extension having a second extension top end, a second extension bottom end and a second extension channel extending therein between, said second extension bottom end being associated with said second inner tube end of said second inner tube section to place said second extension channel in communication with said second channel for communicating air to said second extension top end, said second extension and said second drying arm being pivotally rotatable with said second housing connector, said second extension movable in a radial direction along a common axis extending through said first extension and said second inner tube section, said second extension being movable relative to said second inner tube section between a closed position in which said second extension top end is proximate said second inner tube end of said second inner tube section and an open position in which said second extension top end is positioned a distance away from said second inner tube end selected to receive and support a glove thereon, said second extension top end being configured to communicate air therethrough into said glove positioned thereon.

11. The drying apparatus of claim 10 wherein said first outer tube section and said second outer tube section are formed from rigid tubular material and wherein said first inner tube section and said second inner tube section are formed at least in part of a flexible tubular material.

12. The drying apparatus of claim 11 further including a first airflow director connected to said first outer tube end of said first outer tube section to direct air toward the toe of said ski boot and a second airflow director connected to said second outer tube end of said second outer tube section to direct air toward the toe of said ski boot.

13. The drying apparatus of claim 8 wherein said second outer tube section is formed from a substantially rigid material, and wherein said second inner tube section includes at least a portion of hollow flexible tubing.

14. The drying apparatus of claim 7, further including a second airflow director attached to said second end of said second drying arm and formed to communicate air between said second channel and exterior an aperture of said second airflow director.

15. The drying apparatus of claim 14, wherein said aperture of said second airflow director has an axis and wherein said second airflow director is movable to position said axis between a first orientation and a second orientation different from said first orientation.

16. The drying apparatus of claim 15 wherein said fan means urges air toward said second housing aperture, through said second channel and out of said second airflow director.

* * * * *